United States Patent [19]

Vesely

[11] Patent Number: 4,756,050

[45] Date of Patent: Jul. 12, 1988

[54] VACUUM CLEANER ATTACHMENT FOR CLEANING A MULTIPLE OF SLATS OF A VENETIAN BLIND

[76] Inventor: James G. Vesely, 382 Hamilton St., Costa Mesa, Calif. 92627

[21] Appl. No.: 98,951

[22] Filed: Sep. 21, 1987

[51] Int. Cl.[4] ..... A47L 4/00; A47L 9/02

[52] U.S. Cl. ..... 15/394; 15/210 A

[58] Field of Search ..... 15/393–400, 15/210 A

[56] References Cited

U.S. PATENT DOCUMENTS

| | | | |
|---|---|---|---|
| 2,178,849 | 11/1939 | Breuer | 15/394 |
| 2,231,802 | 2/1941 | Diggs | 15/394 |
| 2,271,694 | 2/1942 | Johnson | 15/394 |
| 2,276,078 | 3/1942 | Marks et al. | 15/394 X |
| 2,487,444 | 11/1949 | Ines | 15/394 |
| 2,490,892 | 12/1949 | Westhoff | 15/394 |
| 2,558,253 | 6/1951 | Ines | 15/394 |
| 2,559,420 | 6/1952 | Westhoff et al. | 15/394 |
| 2,608,710 | 9/1952 | Zaidan | 15/394 |
| 2,611,917 | 9/1952 | Ventsais et al. | 15/394 |
| 2,652,583 | 9/1953 | Tomanica | 15/394 |
| 2,663,046 | 12/1953 | Goguen | 15/394 |
| 2,804,640 | 9/1957 | Zaidan | 15/394 |
| 2,821,736 | 2/1958 | Kasper | 15/394 |
| 2,845,651 | 8/1958 | Woodruff | 15/394 X |
| 3,045,275 | 7/1962 | Delacretaz | 15/394 X |
| 3,520,018 | 7/1970 | Zaidan | 15/394 |

FOREIGN PATENT DOCUMENTS

| | | | |
|---|---|---|---|
| 160686 | 1/1955 | Australia | 15/394 |

*Primary Examiner*—Robert W. Jenkins
*Assistant Examiner*—S. Gerrity

[57] ABSTRACT

This invention relates to a vacuum cleaner attachment for the purpose of simultaneously cleaning a plurality of slats of a Venetian blind and comprises: A molded body 20, a vertical handle 24, a tubular neck 22, having communication with the body and adapted to be connected to a vacuum cleaner hose (not shown), rectangularly shaped fingers 26 which have communication with the body and extend out horizontally from the side of the body opposite the handle, and each opposing finger face having apertures 44 on a longitudinal center axis, rectangularly shaped brush plates 38 having approximately the same lateral dimensions as the finger faces and having apertures 40 in registry with apertures on the opposing finger faces, brush plates slide on and off the finger faces by way of a channel 34 and lip structures 32 and small tabs 48 on the lip structure lock the brush plates in place, bristles 46 will be affixed to the brush plate faces and extend towards each other when locked in place on opposing finger faces. When in use the operator will grip the handle and insert the fingers of the attachment between the open slats of a Venetian blind, thereby simultaneously sandwiching five of the slats with opposing brushes and while extending the fingers lengthwise between the cords of the blind the attachment will loosen and remove the dirt which will then be carried away by air currents through the apertures and passages of the fingers, body and neck.

10 Claims, 2 Drawing Sheets

VACUUM CLEANER ATTACHMENT FOR CLEANING A MULTIPLE OF SLATS OF A VENETIAN BLIND

BACKGROUND—FIELD OF INVENTION

This invention relates to a vacuum cleaner attachment for the purpose of cleaning a plurality of Venetian blind slats simultaneously.

BACKGROUND—DESCRIPTION OF PRIOR ART

For the average person cleaning their Venetian blinds was a rather laborious task. Having many slats in close proximity meant the person had to wipe with a cloth each slat surface individually and while doing so had to be careful not to apply too much pressure so as not to bend the thin metal slats. This method of cleaning Venetian blinds is very tedious and time consuming. In an attempt to alleviate these problems devices have been patented, but to my knowledge none of the devices that are used as a vacuum cleaner attachment have been manufactured or put on the market. The only device I have seen on the market for cleaning Venetian blinds did so without attachment to a vacuum cleaner and comprised a solid plastic body with handle and extending from the body are spaced horizontal wires with brush mediums that straddle the slats of a Venetian blind, and while extending lengthwise between the cords would attempt to clean several slat surfaces simultaneously. The main problem with this device was that the dirt was simply smeared from on location to the next and not removed. In an attempt to overcome the problem of the dirt being smeared and not removed the devices of the prior patents attached their cleaning device to a vacuum cleaner hose, whereby in conjunction with brushes that loosen the dirt and apertures that allow air currents created by the vacuum source to pass over and remove the dirt from the slat surface. After close examination of these prior patents one can see their many deficiencies and the improvements I have made in the design of my invention. For example in U.S. Pat. Nos. 2,490,892 to Westhoff, 1949 Dec. 14, 2,558,253 to Ines, 1951 June 26, 2,599,420 to Westhoff, 1952 June 3, 2,608,710 to Zaidan, 1952 Sept. 2, and 3,520,018 to Zaidan, 1970 July 14, the structures (which will be referred to as fingers) that are inserted between the slats to be cleaned cannot be replicated without major design changes, therefore they are limited in that they can only clean one slat at a time. In U.S. Pat. No. 2,611,917 to Ventsais, 1952 Sept 30, the finger design can be replicated to clean several slats at a time, but fails to sandwhich all of the slats with opposing brushes. The apertures which are on the perimeter of the finger faces are effective in cleaning in a localized area only and the reduced area of bristles around the apertures limits the efficiency of the brushes in this area. U.S. Pat. No. 2,845,651 to Woodruff, 1958 Aug. 5, is shown cleaning several slats simultaneously, but does so with bristles that are parallel to the slats being cleaned which is an inefficient method for removing dirt off both the top and bottom surfaces of the slats. In U.S. Pat. No. 2,271,694 to Johnson, 1942 Feb. 3, the tubular fingers also can be replicated, but the brush material is affixed to a fabric sock which slides over the fingers and both the fabric sock and the brush material would severely block the air flow through the apertures. The fabric sock which slides on and is not permanently attached to the tubular fingers would also have a tendency to rotate as the attachment is moved along the slats. In U.S. Pat. No. 3,045,275 to Delacretaz, 1962 July 24, the tubular fingers have slots in which foam pads are placed. When in use these pads are flexed, opening the slots and allowing the air to enter the fingers. The foam pads would not be as effective as bristles because they would have a tendency to smear the dirt, and the slot openings would be a considerable distance from the slats, thereby allowing air currants to easily bypass the slat surface. U.S. Pat. No. 2,663,045 to Goguen, 1953 Dec. 22, is overly complex and would be rather expensive to manufacture. When the fingers are pivoted open it would be impossible to insert them into blind slats of close proximity, such as mini-blinds. U.S. Pat. No. 2,231,802 to Diggs, 1941 Feb. 11, is limited in that it has only one vacuum slot on one side of each tubular finger, thereby limiting the cleaning efficiency. All the prior patents with exception to U.S. Pat. No. 2,663,046 to Gougen, 1953 Dec. 22, the handle of the attachment is the tubular neck portion which is at an angle to the fingers. This does not allow the hand to firmly grip or to be in a comfortable position when the attachment is in operation. Brush platforms are also shown but are either too narrow, have insufficient brush material or are difficult to remove and replace.

OBJECTS AND ADVANTAGES

Accordingly, I claim the following objects and advantages of my invention: To provide an attachment for conventional vacuum cleaners which is so designed for insertion between the slats of Venetian blinds, while there between and extending will efficiently loosen and remove dirt and dust which is then carried away through apertures and passages to a vacuum cleaner, to provide such an attachment with a vertical handle that allows the operator to firmly grip and use the attachment in a comfortable position, to provide such an attachment with a multiple of rectangular shaped fingers of a simple design which can straddle and clean the top and bottom surfaces of several slats simultaneously, to provide such an attachment with easily removeable rectangular shaped brush plates that slide on and off the finger faces, whereby they can be easily cleaned or replaced, to provide such an attachment with brush plates that have an increased area and improved location of bristles which extend to the outer edges of the brush plate face, thereby allowing the brushes of the attachment to contact the slat area adjacent to the cords of the blind being cleaned, to provide such an attachment with centrally located apertures of an appropriate size to produce a regulated central vacuum area on each brush plate face.

Readers will find further objects and advantages of the invention from a consideration of the ensuing description and the accompanying drawings.

Drawing figures

Figure 1:
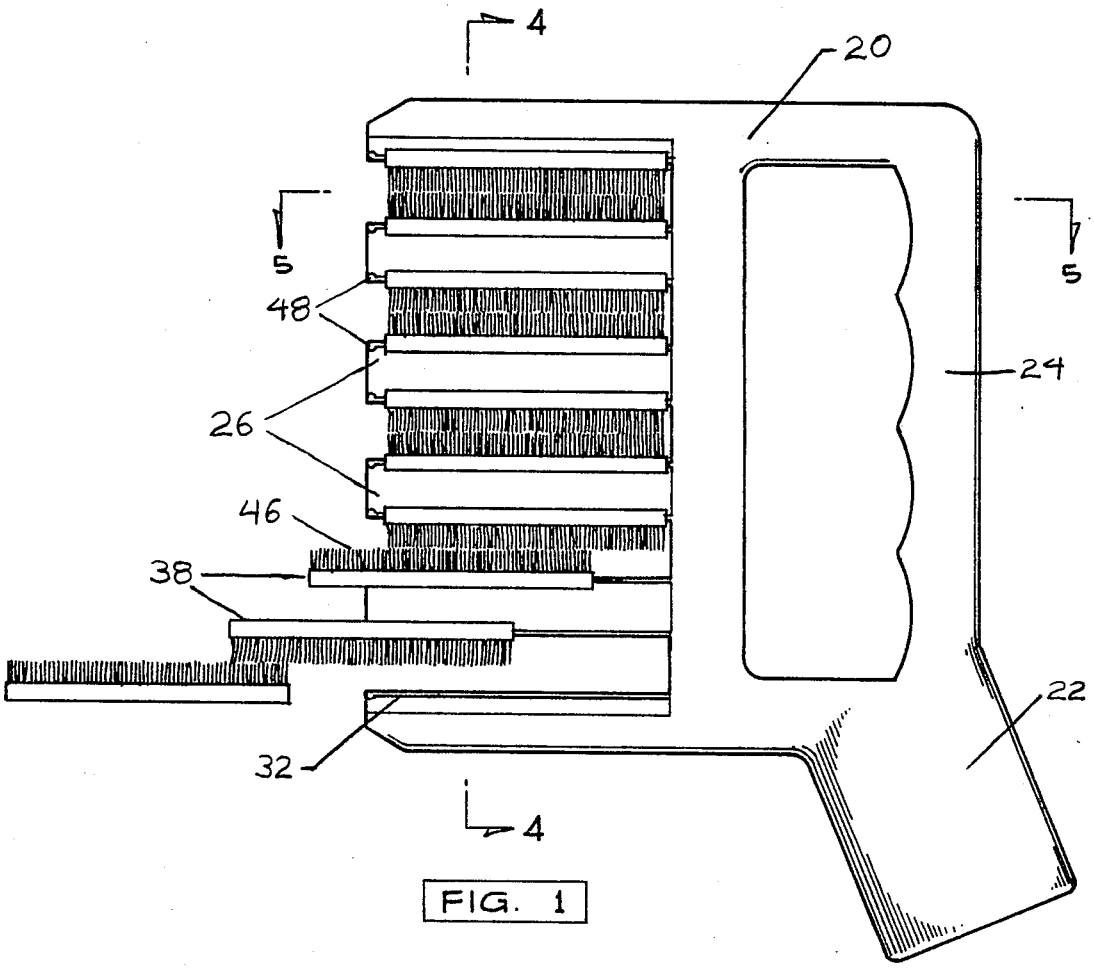
FIG. 1 shows a side elevation view of the Venetian blind cleaner with seven brush plates fully in place, two brush plates partially removed and one brush plate fully removed.
Figure 2:
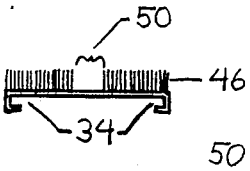
FIG. 2 shows a front side view of a typical brush plate.
Figure 3:
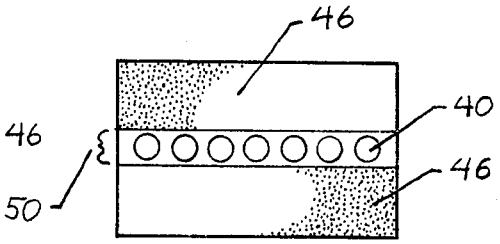
FIG. 3 shows a top view of a typical brush plate.
Figure 4:
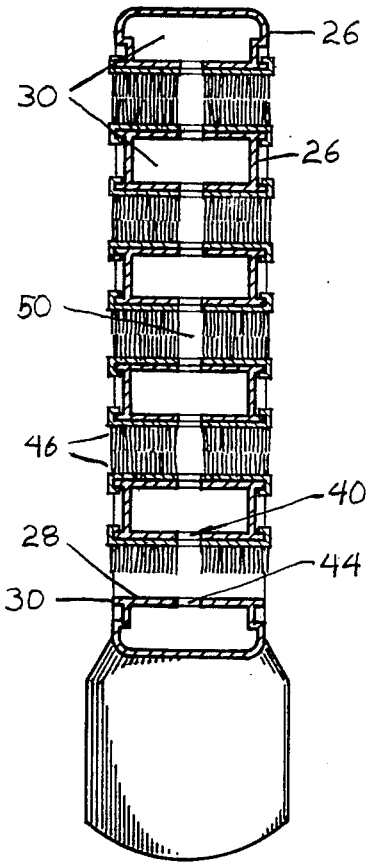
FIG. 4 shows a front sectional view taken on line 4—4 of FIG. 1.
Figure 5:
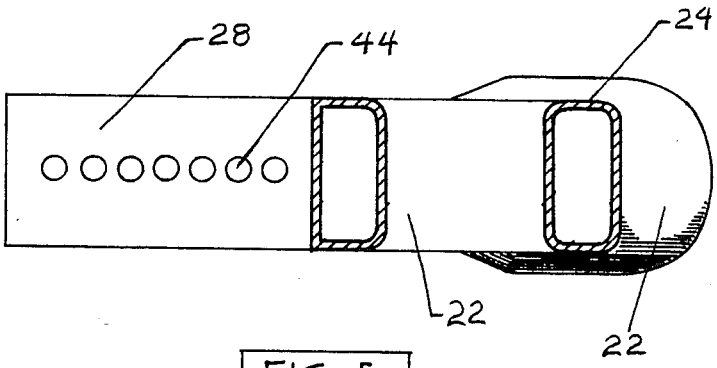

FIG. 5 shows a top sectional view taken on line 5—5 FIG. 1. Description of Preferred Embodiments Referring to FIGS. 1–5 the blind cleaning attachment comprises: a body 20 shown in FIG. 1 having an angled tubular neck 22 which has communication with the body and is adapted to connect to a vacuum cleaner hose (not shown), a vertical handle 24 which is integral to one side of the body and disposed above the tubular neck, at the forward end of the body opposite the handle are six elongated fingers 26 having rectangular faces 28 as shown in FIG. 5, and hollow rectangular cross sections 30 as shown in FIG. 4, the cross section also shows the lip structure 32 that in conjunction with the channels 34 shown in FIG. 2, on the brush plates allows the brush plates to slide on and off each opposing finger face 28 as shown in FIG. 1. Each finger is appropriately spaced so as to straddle the blind slats, while there between and extending lengthwise, can clean ten slat surfaces simultaneously. Referring to FIG. 5, in each opposing finger face 28 are a series of apertures 44 on a longitudinal center axis which communicate with the passages of the fingers, body and neck. Shown in FIG. 2 and 3, are rectangularly shaped brush plates 38 having approximately the same lateral dimensions as the finger faces and having apertures 40 in registry with apertures 44 on the finger faces. Affixed by any appropriate means to the brush plate faces are bristles 46 best shown in FIGS. 2 and 3 which are located on either side of the apertures and extend to the outer edges of the brush plates. When the brush plates are locked in position on opposing finger faces by means of locking tabs 48 shown in FIG. 1, the bristles will extend towards each other in a way so as the bristle ends meet but do not overlap. Shown in FIG. 3, the aperture area 50 along the longitudinal center axis of the brush plates will be excluded of bristles so as not to restrict the apertures and to create a central vacuum area.

OPERATION

When in use the operator will grip the handle and insert the fingers of the attachment between the open slats of a Venetian blind while in a hanging position, thereby simultaneously sandwiching five of the slats with opposing brushes, and while there between the fingers will be extended lengthwise between the cords of the blind. The attachment will loosen and remove the dirt which will then be carried away by air currents through the apertures and passages of, the fingers, body and neck which is connected to a vacuum cleaner hose.

I claim:

1. A vacuum cleaner attachment for cleaning both sides of a plurality of slats of a Venetian blind comprising;

a body with a hollow cross section, means for manually holding one side of said body in a vertical position and angularly inclined to said holding means is a tubular neck portion with a hollow cross section having communication with said body and having means for attachment to a vacuum hose, extending from the opposite side of said side of said body are a plurality of fingers of appropriate length that are horizontal to said body and have opposing rectangular faces, longitudinal edges, and hollow rectangular cross sections, said opposing faces have lip structures which run along the longitudinal edges of the fingers, said fingers being appropriately spaced, whereby said fingers can straddle the slats of a Venetian blind, said opposing rectangular finger faces having apertures on a longitudinal center axis and said apertures communicating with passages of said fingers, said body, and said tubular neck, brush plates being rectangular in shape and having apertures in registry with said apertures on said opposing rectangular finger faces, and having approximately the same lateral dimensions as said opposing rectangular finger faces, a means thereof where said brush plates can be easily mounted or dismounted and means to lock in place said brush plates to said opposing rectangular finger faces, said brush plates having bristles affixed to their faces and when said brush plates are locked in position on said finger faces said bristles will extend towards each other in a way so as the ends of said bristles meet but do not overlap and said bristles will be excluded from an area along said longitudinal center axis, whereby said bristles will not restrict said apertures.

2. The invention of claim 1 wherein said body, said holding means, said fingers, and said tubular neck are molded integrally together as a single unit and have communication with each other.

3. The invention of claim 2 wherein said holding means comprises a vertical handle of appropriate size to be comfortably gripped by the average person.

4. The invention of claim 1 wherein each said opposing rectangular finger face will have two lip structures of appropriate size extending along each longitudinal edge, from said body to the tip of each said opposing finger face.

5. The invention of claim 1 wherein said rectangular brush plates will have channel structures along each longitudinal side of appropriate size, whereby said brush plates can slide on and off each said finger face in conjunction with said lip structures.

6. The invention of claim 1 wherein said locking means will be a tab of appropriate size on each of said lip structures located at the tip of said fingers, thereby locking said brush plates in position on said finger faces.

7. The invention of claim 2 wherein the number of said molded fingers to said body will be six.

8. The invention of claim 1 wherein said fingers are appropriately spaced so as to straddle the slats of a miniblind.

9. The invention of claim 2 wherein said molded integral unit is constructed of a rigid plastic.

10. The invention of claim 5 wherein said brush plates will be constructed of said rigid plastic.

* * * * *